United States Patent [19]

Morita et al.

[11] 4,089,297

[45] May 16, 1978

[54] DEVELOPING APPARATUS OF MAGNETIC BRUSH TYPE FOR ELECTROPHOTOGRAPHIC REPRODUCTION

[75] Inventors: Shizuo Morita; Kiyoshi Kimura, both of Hachioji, Japan

[73] Assignee: Konishiroku Photo Industry Co., Ltd., Nihonbashi-Muro, Japan

[21] Appl. No.: 728,792

[22] Filed: Oct. 1, 1976

[30] Foreign Application Priority Data

Oct. 7, 1975 Japan ..... 50-136326

[51] Int. Cl.[2] ..... G03G 15/06; G03G 15/09

[52] U.S. Cl. ..... 118/647; 118/651; 118/658; 355/3 DD; 427/18

[58] Field of Search ..... 118/656–658, 118/647, 651; 427/18, 21; 355/3 DD, 30 D; 96/1 R

[56] References Cited

U.S. PATENT DOCUMENTS

| | | | |
|---|---|---|---|
| 3,455,276 | 7/1969 | Anderson | 118/658 |
| 3,674,532 | 7/1972 | Morse | 118/657 X |
| 3,754,526 | 8/1973 | Caudill | 355/3 DD |
| 3,932,034 | 1/1976 | Takahashi | 355/3 DD |
| 3,950,089 | 4/1976 | Praser et al. | 118/658 X |
| 3,965,862 | 6/1976 | Yang et al. | 118/651 |
| 3,990,394 | 11/1976 | Katakura | 118/658 |

*Primary Examiner*—James Kee Chi

*Attorney, Agent, or Firm*—Haseltine, Lake & Waters

[57] ABSTRACT

A developing apparatus of the magnetic brush type including an electrical conductive cylindrical member adapted to form heads of a developer and a means for applying a d.c. bias voltage to the heads of the developer. A d.c. bias voltage is connected to said cylindrical member and said means for applying bias voltage, and said d.c. bias voltage applied to said cylindrical member is of the same polarity and magnitude as that being applied to said d.c. bias voltage applying means.

3 Claims, 1 Drawing Figure

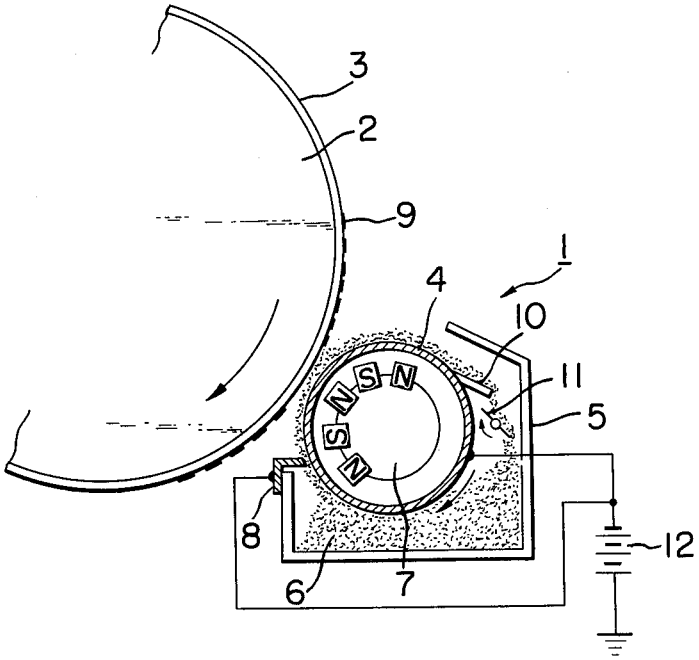
3
2
9
1
4
10
11
5
N
S
N
S
N
8
6
7
12

DEVELOPING APPARATUS OF MAGNETIC BRUSH TYPE FOR ELECTROPHOTOGRAPHIC REPRODUCTION

The present device relates to a developing apparatus for visualizing an electrostatic latent image formed according to the principle of electrophotographic reproduction.

An magnetic brush developing apparatus is known as one of developing means for use in an electrophotographic copying machine. This magnetic brush developing apparatus comprises a supporting member having a plurality of permanent magnets of different polarities disposed alternately thereon in the form of a ring in section and an electrically conductive cylindrical sleeve surrounding said supporting member with a minute clearance from the outer surface of said supporting member, said supporting member and said cylindrical sleeve being arranged to rotate relatively with each other. When an electrostatic image is developed by using this magnetic brush developing apparatus, there arises a problem of "fogging phenomenon". By the term "fogging phenomenon" is meant a phenomenon in which if the development is conducted is the state where the potential of areas other than those not exposed in the exposing step (areas corresponding to image areas on an original to be copied) is not completely reduced to zero, toner particles will adhere to these areas in proportion to the intensity of the residual potential and contamination takes place in the background of the image which should have a color corresponding to the ground color of a transfer sheet (a white color in case of a white transfer sheet being used).

In order to prevent occurrence of this fogging phenomenon, there has been proposed a method in which a direact current bias voltage is applied to the cylindrical sleeve, which voltage is of the same polarity as the polarity for charging the photosensitive material and has an intensity substantially equal to the potential left on areas other than areas of the electrostatic images on the photosensitive material. It is true that this direct current bias-applying method is effective, but the effect is gradually reduced with degradation of the developer. More specifically, a developer for use in the magnetic brush developing apparatus is a mixture of a carrier composed of magnetic particles (normally iron powder) and a toner powder, and may be subjected to an increasing thermal or mechanical change with increase in number of developing operation and adhesion of these particles of the developer to each other is enhanced, resulting in reduction of developing efficiency. This phenomenon is called "degradation of the developer". When the toner powder adheres to the magnetic particles in such a manner as to cover them, even if a bias voltage is applied to the cylindrical sleeve as described above, the developer layer held on the cylindrical sleeve will act as an insulator and therefore it becomes difficult to attain the intended object of preventing occurrence of the fogging phenomenon. In short, this bias voltage-applying method is defective in that the change of the developer with the lapse of time cannot be duly coped with and the effective bias voltage cannot be maintained at a certain level.

The bias voltage-applying method further involves a problem that the developing efficiency is changed with the change in relative humidity. As the frequency of the developing operation increases, a thin film of the toner powder is formed on the cylindrical sleeve (this phenomenon is called "filming phenomenon"). Since this film is of insulating nature, the action of the effective bias is eventually reduced by this film. With the experiments conducted with cylindrical sleeves of conductive materials such as stainless steel, copper, brass and aluminum with its surface oxidized (so-called alumite), the filming phenomenon was noticed. This phenomenon was conspicuous when the humidity was low. In the conventional bias voltage-applying method, the applied voltage is normally kept constant, and accordingly, it has been found that if a standard bias voltage is set based on a relatively high humidity such as a relative humidity of 60 to 75%, when an image is formed in an atmosphere of low humidity such as relative humidity of 20 to 30%, no effective bias is attained and fogging takes place. In contrast, if the bias voltage is set based on a low humidity, when an image is formed in an atmosphere of high humidity, the value of the electric current passing on the side of the photosensitive material through the developer layer exceeds a necessary value. Accordingly, with the photosensitive material consisting of a layer of zinc oxide dispersed in resin, the surface of the zinc oxide layer is destroyed, with the result that a band-like fog (so-called "banding") is formed on the destroyed surface of the photosensitve material that is in contact with the developer layer.

For the reasons set forth above, only bias voltages in a very narrow range are applicable, and phenomena caused both at a high and a low humidity cannot be completely overcome.

It is a primary object of the present invention to overcome the foregoing defects involved in the bias voltage-applying method and to ensure an effective bias irrespective of degradation of the developer or of whether the relative humidity is high or low to prevent the fogging phenomenon.

More specifically, there is proposed according to the present invention a developing apparatus comprising an electrically conductive cylindrical member disposed to extend in the widthwise direction of a photosensitive material so as to hold a developer and define a flow passage thereof, permanent magnets disposed in proximity to the inner circumference of said cylindrical member and at suitable positions in the direction of the inner circumference of said cylindrical member in such a manner as to rotate relatively with said cylindrical member, means for applying a d.c. bias voltage to heads of the developer and a d.c. voltage source adapted to be connected to said cylindrical member and said means for applying a d.c. bias voltage to both the cylindrical member and the developer, so that appyling a bias voltage to heads of developer, exactly keeped charge on developer.

The present invention will not be described by reference to the accompanying drawing schematically showing the developing apparatus according to the present invention.

A magnetic brush developing apparatus 1 according to the present invention is disposed in proximity to a rotary drum 2 having on the surface thereof a photosensitive material 3 composed of a zinc oxide layer or the like. In this magnetic brush developing apparatus 1, an electrically conductive cylindrical sleeve 4 is rotatably mounted in an insulatingly coated vessel 5 containing therein a developer 6. Permanent magnets of different polarities are disposed alternately in the cylindrical sleeve 4 and fixed by a supporting member 7 so that the magnets are positioned in proximity to the inner circumferential face of the cylindrical sleeve 4. This cylindrical sleeve 4 is disposed in proximity to the rotary drum 2 so that at the developing step, heads of the developer have sliding contact with the surface of the photosensitive material 3. A head regulating plate 8 (hereinafter referred to as "a head cutting plate") is attached to one end of the developer vessel 5 by proper means such as resin or screws. This head cutting plate 8 is composed of an electrically conductive material, and its top end is spaced by a certain distance from the surface of the cylindrical sleeve 4 so that it falls in contact with developer head formed at the developing step to regulate the length thereof.

The cylindrical sleeve 4 is rotated in a direction indicated by an arrow in the drawing, and at a suitable position where heads formed on the surface of the cylindrical sleeve 4 arrive after completion of development of an electrostatic latent image 9 on the surface of the photosensitive material 3 while they are rotated with the cylindrical sleeve 4, a developer scraping plate 10 is fixed by suitable means. An agitating plate 11 is mounted at a suitable position below this scraping plate 10. The scraped developer is sufficiently agitated by this agitating plate 11 and returned into the developer vessel 5.

In the developing apparatus having the above structure, in order to prevent occurrence of the fogging phenomenon, a negative pole of a direct current source 12 is connected to the cylindrical sleeve 4 while a positive pole of the d.c. current source 12 is grounded and the negative pole of the d.c. source 12 is directly connected to the head cutting plate 8, whereby the difference of the potential from the residual potential left in unexposed areas of the photosensitive material is made as small as possible. In this case, not only the polarity of the potential applied to the cylindrical sleeve 4 but also the polarity of the potential applied to the head cutting plate 8 is the same as the polarity for charging of the photosensitive material 3 and the intensity of each potential is made substantially equal to the residual potential on the unexposed areas. Accordingly, if the charging polarity of the photosensitive material 3 is positive, the polarity of each of the potentials applied to the cylindrical sleeve 4 and the head cutting plate 8 is made positive.

If a bias voltage is thus applied to not only the cylindrical sleeve 4 but also the head cutting plate 8, the bias current is increased and hence, occurrence of fogging at a low humidity owing to reduction of the bias current (deemed to be due to degradation of the developer) can be prevented. Further, in the relation between the current passing through the head cutting plate 8 (hereinafter referred to as "the Head current") and the current passing through the sleeve 4 at a low humidity or high humidity, the Head current acts as a float. More specifically, if the humidity is high, the Head current is weakened and the sleeve current becomes relatively large, whereas at a low humidity, the Head current is increased and the sleeve current is weakened. Herefore, an effective bias can be ensured and occurrence of banding can be effectively prevented. In the present device, the reason why the vessel 5 is insulatingly coated is that passage of an electric current through the apparatus proper by the bias voltage applied to the head cutting plate 8 is prevented. The invention can be carried out with a cylindrical sleeve made of conductive material such as a stainless steel, a brass or aluminum and a superior effect of prevention of fogging phenomenon is obtained with a cylindrical sleeve made of aluminum with its surface oxidized (so-called alumite).

According to the present device, by applying a d.c. bias voltage to the cylindrical sleeve and simultaneously applying a bias voltage of the same polarity to the head cutting plate for the developer, it is possible to ensure that more electrical charges are held on the developer and thus to prevent degradation of the developer and the fogging phenomenon at low humidity and banding at high humidity.

In the embodiment shown in the drawing, the head cutting plate for the developer was used to apply a d.c. bias voltage to the heads of developer prior to developing action, however, the head cutting plate may be replaced by any other means provided for this purpose, for example an electrode plate disposed to contact heads of the developer prior to developing action. The cylindrical sleeve 4 of the developing apparatus is rotatably mounted, but the developing apparatus is not limited to this type but modifications can be made. For example, it is possible that the cylindrical sleeve is stationary and the magnet supporting member 7 is disposed inside the cylindrical sleeve in such a manner as to be able to rotate therein. In this case, however, it is preferred in order to obtain a uniform developing effect and prevent appearance of staged unevenness in a copied image, that magnets of different polarities be arranged alternately along the entire circumferential surface of the supporting member.

What we claim is:

1. A developing apparatus of magnetic brush type comprising: an electrically conductive cylindrical member disposed adjacent to a photosensitive body and adapted to form heads of a developer on the outer circumference of said cylindrical member; a plurality of permanent magnets of different polarities arranged in proximity to and along the inner circumference of said cylindrical member; said cylindrical member being rotatable relative to said permanent magnets so that the developer rubs the surface of the photosensitive body with the heads thereof formed on the outer circumference of said cylindrical member; a d.c. power source; means for applying a d.c. bias voltage to the heads of the developer prior to its contact with said photosensitive body; both the cylindrical member and the d.c. bias voltage applying means being electrically connected to said d.c. power source; said d.c. bias voltage applying means being a head cutting plate disposed oppositely to said cylindrical member so as to extend widthwise of the photosensitive body, said d.c. bias voltage applied to said cylindrical member being of the same polarity and magnitude as that applied to the d.c. bias voltage apply means.

2. A developing apparatus as set forth in claim 1, wherein said conductive cylindrical member is comprised of aluminum having an oxidized surface.

3. A developing apparatus as defined in claim 1, wherein said conductive cylindrical member is comprised of aluminum having an oxidized surface, said cylindrical member being connected to a negative pole of said d.c., said head cutting plate being also connected to said negative pole, said d.c. source having a positive pole connected to ground potential, the difference of potential from residual potential left in unexposed areas of said photosensitive body being substantially small, the intensity of each potential applied to said cylindrical member and said cutting plate being substantially equal to the residual potential on the unexposed areas, current passing through said head cutting plate being relatively low and current passing through said cylindrical member being relatively large at high ambient humidity, said current through said head cutting plate being increased and the current through said cylindrical member being decreased at substantially low humidity, said voltage applied to said cylindrical member and the voltage applied simultaneously to said head cutting plate increasing the electrical charges held on the developer for preventing degradation of the developer, said head cutting plate being positioned upstream of the developing location.

* * * * *